US005613803A

United States Patent [19]

Parrish

[11] Patent Number: 5,613,803

[45] Date of Patent: Mar. 25, 1997

[54] METHOD AND APPARATUS FOR THE AUTOMATED CONTROL OF CANALS

[76] Inventor: John B. Parrish, 3634 Foxana Dr., Iowa City, Iowa 52246

[21] Appl. No.: 447,763

[22] Filed: May 23, 1995

[51] Int. Cl.[6] ..... E02B 7/20; E02B 7/42

[52] U.S. Cl. ..... 405/92; 405/52; 405/80

[58] Field of Search ..... 405/92–96, 52, 405/80, 86–91

[56] References Cited

U.S. PATENT DOCUMENTS

| | | | |
|---|---|---|---|
| 3,910,052 | 10/1975 | Whitlock . | |
| 3,942,328 | 3/1976 | Bunger . | |
| 4,036,023 | 7/1977 | Matsumoto et al. | 405/92 |
| 4,180,348 | 12/1979 | Taylor . | |
| 4,332,507 | 6/1982 | Wakamori et al. | 405/92 |
| 4,449,851 | 5/1984 | Combes et al. . | |
| 4,522,534 | 6/1985 | Wakamori et al. | 405/92 X |
| 4,604,681 | 8/1986 | Sakashita | 405/92 X |
| 4,772,157 | 9/1988 | Obermeyer | 405/92 X |
| 4,890,955 | 1/1990 | Mercier . | |
| 4,963,057 | 10/1990 | Fournier . | |

FOREIGN PATENT DOCUMENTS

| | | | |
|---|---|---|---|
| 0187209 | 7/1989 | Japan | 405/96 |

OTHER PUBLICATIONS

Guy Chevreau and Sylvie Schwartz–Benezeth, "Bival System for Downstream Control".

*Primary Examiner*—Dennis L. Taylor

*Attorney, Agent, or Firm*—LaRiviere, Grubman & Payne

[57] ABSTRACT

Method and apparatus for the automated control of canals. The present invention achieves and maintains steady state operation in each pool of a canal despite changing demands. Each pool in the canal is controlled separately by its own pool controller. The present invention teaches that control of a canal depends both on controlling the level of fluid in the canal at key locations. To attain this end, the present invention provides two separate control functions within each pool. First, a pool controller constructed according to the principles of the present invention attains and maintains pool level control indirectly by means of pool volume control, i.e. by controlling the pool volume where the flow is known. Second, and subservient to maintaining the pool level, the pool controller maintains sufficient flow through each pool by means of flow control at the pool's inlet, such that both the pool's demands and necessary volume, as well as the demands and necessary volumes of all pools downstream are correctly accounted for. Finally, the present invention manages the overall control objectives for the canal by electronically linking the pool controllers and by appropriately modifying the pool controller logic. In this manner upstream control, downstream control, or hybrid forms of canal control can be implemented by means of the present invention.

14 Claims, 7 Drawing Sheets

METHOD AND APPARATUS FOR THE AUTOMATED CONTROL OF CANALS

TECHNICAL FIELD

The present invention relates to the automated control of canals. In particular, the present invention teaches a method and apparatus which hydraulically de-couples existing sloping top canals and establishes computerized electronic control of the individual pools thereof. The methodology taught herein is accomplished without relying on direct measurement of flow through the canal.

BACKGROUND ART

Canals are used throughout the world to deliver water from where it is available to where it is needed. Because the costs of building a high-capacity canal are significantly lower than the costs of building a pipeline of equal capacity, canals and open channels are the primary conveyance device for water for agricultural production.

Water delivery canals are generally considered to be a series of sloping pools. Of the several pools which make up most canals, a delivery pool is said to be the pool from which a given demand is initiated. Conveyance pools are all the pools upstream from the delivery pool, which pools transfer the change in flow required by the change in demand. A pool can be either or both a conveyance pool and a delivery pool. Further a sloping pool may be formed with either a level or sloping top.

A major concern facing operators and users of these canals is the scheduling and delivery of water according to the user's needs. This is the problem of canal control.

The earliest canal control systems were based on the theory of upstream control of the canal. A major problem with upstream canal control is that the user (e.g., a farmer) cannot initiate, terminate or modify the flow rate of water at the point of delivery. Instead, the flow rate in the canal is controlled from the headworks, and deliveries to users are scheduled. Since it is often the case that delivery needs and scheduled deliveries do not coincide, a canal operated by schedule under upstream control not only wastes water, but is inaccurate and nonresponsive to changes in user needs. To overcome these problems, workers in the art have been trying for many years to make downstream control a practical reality. Downstream control, as used herein, refers to a canal control methodology which is literally operated or controlled by the user from the downstream part of the canal where the user's turnout is located. To date none of the downstream control methodologies have proven both practical and reliable on a wide variety of existing canals.

By way of further defining the prior art, upstream control generally works in the following manner: To fill the user's water order, the canal operator controls the canal flow starting at the headworks. This control then works in the downstream direction. Each user is required to give some advance notice of desired deliveries so that the canal's schedule can be assembled from all of the users' demands. The canal schedule must accommodate travel times of several hours to several days from the headworks to the user's point of delivery, or turnout. The water provided according to the user's request is hence not available to that user until the travel time from the headworks has elapsed. A major problem with upstream control methods is the fact that they rarely deliver accurate amounts of water to the user. A second major problem is that changes in user needs cannot be timely accommodated. Finally, upstream control wastes water, creating both water shortfalls and surpluses.

In contrast to upstream control, according to the tenets of downstream control, the canal operator would not necessarily be notified in advance of user demands or rejections. Indeed, in the best implementation of this methodology, changes in user demands at any point in the canal would have no impact on deliverability of water to any other user. Instead, an ideal downstream control method would ensure that sufficient water was available for all users at all times with neither water surpluses nor shortfalls to contend with. To date, efforts to implement this ideal downstream controller have not met with success for several reasons enumerated below.

Where price is no object, particularly for very large water distribution systems it has been possible, at significant expense, to derive suitable customized control systems. However, for more modest distribution systems, where price versus functionality is a consideration, methodologies for canal control have not been sufficiently effective.

Efforts by others to implement downstream control of such canals have generally utilized two broad strategies: role-based controllers and control theory-based controllers. Rule-based controllers use a pre-defined set of control actions which are implemented responsive to some sensor input from the canal. Control theory-based controllers use control theory to generate control actions based on canal sensor inputs. Prior to discussing the shortcoming of these prior art methodologies, it is instructive to examine how canals respond to changes in demand and to compensating flows.

If more water is drawn from a pool than flows into it, the pool eventually runs dry. A pool surface level at the pool's downstream end, and showing such an uncompensated demand over time is shown at FIG. 1. Conversely, if less water is drawn from a pool than flows into it, the pool eventually overflows. A second pool surface level showing an uncompensated rejection is shown at FIG. 2. If however, the increased demand is met with an instantaneous and equal increase in inflow, as shown in the hydrograph shown in FIG. 3, a pool surface level such as depicted at FIG. 4 results. This increased inflow is termed a "flow-compensating in-flow".

Most prior art canal control methodologies rely on the use of a setpoint to provide a data point for canal control. In the simplest example, a level setpoint implemented at some point in the canal tells the canal controller if the water is either too high or too low in the pool. The controller then takes the appropriate control action to restore the water level at the setpoint to the desired level. Setpoints may be established at any point in a pool, and each of such locations has its advantages and disadvantages.

Study of FIGS. 3 and 4 makes it apparent that while the flow-compensated inflow prevents the pool from running dry (at least in this pool), the level of the pool at the setpoint location is decreased (in this case, the setpoint is positioned at the downstream end of the pool). This is due to the phenomenon illustrated in FIG. 5. As shown in that figure, as additional inflow is input to overcome the increased demand, the pool surface profile pivots with the additional inflow. This is due to the additional energy, and hence the steeper surface slope, which is necessary to sustain the larger flow. In order to both sustain the increased flow and to maintain the original level of the canal at the downstream end of each pool (hereafter referred to as the setpoint target depth), it is necessary to increase the volume of the pool in addition to increasing the inflow. Maintaining control of a canal, or the pool of a canal, is therefore seen to be a problem having two components. First, inflow must be changed to reflect changes in outflow, i.e. there must be a flow-compensating inflow. Indeed, inflow must equal outflow or the pool either runs dry or overflows; i.e., there must also be a volume-compensating inflow. Secondly, pool volumes must be adjusted to maintain the setpoint of the canal.

Referring now to FIG. 6, the surface profile of a pool having an upstream setpoint pivots about that setpoint, and the surface level at the downstream end of the pool drops with an increase in throughflow. FIG. 7 shows a pool with a midpool setpoint. Here, the surface profile also pivots about the setpoint, and with an increase in throughflow the surface level at the downstream end of the pool also drops, but the surface level upstream of the pivot point rises. Finally, FIG. 8 shows a pool with a downstream setpoint, the situation previously illustrated in FIGS. 1 through 5; once again, changes in throughflow cause the surface profile to pivot about the setpoint, and changes in throughflow result in changes in pool surface level at the upstream end of the pool.

Some of the earliest prior art efforts at downstream control utilized setpoint locations at the upstream end or middle of the pools. This is not possible however with pools which have sloping tops. With sloping top canals the setpoint location must be at the downstream end of the pool or the water will overflow the canal banks when the surface profile pivots counter-clockwise in response to a decrease in throughflow.

As shown in FIG. 4, if only the increased inflow is compensated, the pool volume remains constant, the pool surface pivots, and the setpoint target depth (i.e., at the downstream end of the pool) is abandoned. Abandoning the setpoint target depth means that control of the pool is abandoned.

The hydrograph of a pool which is compensated both for flow and volume following an increase in demand is shown at FIG. 9, and pool depth at the setpoint location and the volume of that pool is shown at FIG. 10. In contrast, FIG. 11 depicts an example of a rejection which is compensated both for volume and flow.

To establish and maintain control of canals, some prior art control methodologies utilized relatively few inputs, but made use of vastly more complex mathematical descriptions of the dynamics of pool flows. Among the best mathematical models of pool flow dynamics are the "de St. Venant" equations, which relate time, flow and depth at any point in the pool or the canal. While they are correct, they are very complex and difficult to simplify. They are particularly difficult to linearize in any effective manner to provide applications using control rules.

Once the depth at the setpoint location changes, the control action required of a pool controller is to change the pool's inflow (at the upstream end). This control action (the change in inflow) sends a wave down the pool. The effect of the control action on the pool depth at the setpoint location (the downstream end) is delayed by the wave's travel time down the pool. This effect is further complicated by the fact that the wave is attenuated as it travels down the pool. Since prior art controllers utilize the depth at the setpoint location as the sole or primary input for control, they must contend with this lag time and attenuation and are therefore less effective. These prior art controllers must "wait" to determine if a given control action was sufficient, insufficient or excessive.

FIG. 10 depicts an example of this problem. As shown in that figure, volume compensation is completed in this exemplar pool at approximately t+40 minutes, or 30 minutes after the increase in demand is initiated at t+10 minutes. Recovery of depth at the setpoint location is however not completely effected until t+52 minutes, or 12 minutes after volume compensation is complete.

In attempting to manage the compensating inflow as a monolithic entity in the face of significant lag time and wave attenuation between control action and ultimate effect, the prior art must provide significant ongoing control action. It will be immediately appreciated then that the prior art attempts to manage a very complex problem, in that prior art controllers must allow for delay and attenuation, thereby further complicating the controller's rule or instruction set.

Pool controllers according to the prior art must either control the canal as a whole, or control only a portion of the canal. The former case is a complex and computationally huge problem. The latter case leaves the uncontrolled balance of the canal at the mercy of seemingly random, but significant, hydraulic influences which come from outside the controller's domain. This means that every event in any pool effects the pools adjacent thereto. Thus, every event in every pool has some effect on the entire canal. These external influences are difficult to manage, especially in canals with poor controllability. Furthermore, the prior art has failed to adequately quantify these influences, precluding the ability to transmit them to adjacent pool controllers electronically.

Unless a means is found to hydraulically de-couple the several pools of a canal, a canal controller must either control all the influences in the entire canal with a monolithic set of rules or equations. Alternatively, a controller must control portions of the canal without regard to conditions in other pools. The former case is a formidable computational effort. The latter case means of course that the canal operator and users must suffer the consequences of significant exogenous influences coming from adjacent and independently controlled parts of the canal. It is well documented that the latter option tends to magnify control problems in the upstream direction.

Taken in sum, the above difficulties have generally precluded the economical fielding of a downstream canal methodology useful over a variety of canals. This is especially true of "difficult" canals. Indeed the prior art does not define those factors which make a canal system controllable, and to allow for them. In general, efforts by other workers in the art have targeted the control problems which pertain to an existing pool, or a hypothetical pool created by averaging several of the characteristics of many existing pools. One example of this "average" pool consisted of combining the geometries of some one hundred pools and finding their arithmetic mean. The resultant "average pool" provided by happenstance a very benign control environment for the controller created in that study to control. This effort then completely disregarded the real-world case where one or more pools in a canal may well be especially challenging from the control perspective. This means that there is little prior art methodology for determining to what extent a given canal is even susceptible to control.

Another problem faced by many prior art downstream control methodologies is that they apply only to canals having level tops, but may not be implemented on sloping top canals. Worldwide, the majority of irrigation canals are built with a sloping profile. Most of these canals have tops which are approximately parallel with the floor, or invert, profile. Hence the tops of most water delivery canals are sloping in profile, and furthermore, most utilize downstream setpoints, where at near-zero flows the canal will not overflow its banks. In order to be an economically feasible alternative to current upstream control methodologies, a downstream control method must be implementable as a retrofit on existing sloping top canals at minimal cost: i.e., without requiring the rebuilding of the canal.

As a final problem exacerbating the computational effort required by most prior art downstream controllers, the methodology whereby the desired inflow is implemented at the upstream gate is seldom idealized. Because the direct measurement of flow in a canal is both problematic and expensive, it is common practice in the prior art to attempt to control inflows by simple position of the inflow gate leaf itself. This methodology fails to account for the fact that a variety of conditions exist which determine the flow through an inflow gate, and gate position, or orifice size, is only one of them.

There are other generalized problems encountered by prior art downstream control theory or rule-based controllers. Controlling the canal as a whole, using numerous inputs from the throughout the canal system is problematic and expensive. It is outside the capability of rule-based controllers due to the sheer complexity of the problem unless control dynamics are limited or expensive in-line reservoirs are utilized. This problem is also difficult to solve using control theory-based controllers both because of problem complexity and because the required rule matrices become very large and are hence difficult to timely solve with modest computer hardware. When some form of local control is implemented, then both rule-based and control theory-based controllers must contend with the interactions between the independently controlled canal sections. The prior art has failed to adequately manage these problems. Furthermore, the prior art has failed to appreciate those factors which affect the controllability of a canal. It therefore follows that the prior art cannot judge how effective the control methods taught thereby operate in the face of those factors. Prior art control systems further utilize dynamic control constants which are difficult both to derive and to tune after controller deployment.

In addition to shortcomings common to both rule-based and control theory-based controllers, there are problems which are unique to the former. Some prior art rule-based downstream controllers utilize an ambiguous rule set. These rule set ambiguities tend to evince themselves at interfaces between cases, i.e., where slight variations in sensor input cause the selection of one case over another. If the two cases possible for selection produce significantly different responses, the system is often led to dithering and possible loss of control.

Prior art control theory-based controllers also have some problems unique thereto. First, modern control theory has little or no inherent ability to properly manage the spatial attributes of the controlled system. Control theory is focused on time-based system dynamics. The previously discussed problems of lag time and wave attenuation which separate control action from the controlled element are very difficult to manage. Second, the mathematics that properly describe the flow dynamics are complex and difficult to simplify in an effective manner. This is especially so since pool flow rates are not practically available as inputs to the control system.

Finally, it will be appreciated that gaining and maintaining effective control of the entire canal is significantly more difficult than controlling each pool of the canal. If each pool in the canal were accurately controlled, it follows that the canal as a whole must be accurately controlled.

The preceding discussion reveals several weaknesses in prior art downstream control methodologies. A canal controller which provided downstream control for canals and was easily and economically implementable on a wide variety of existing canal systems, including canals with sloping tops, would present significant advantages in water economy and management over prior art methodologies. In order to be fully implementable, such a controller must simplify the computational effort required of prior art controllers. This simplification could come from several sources. A first area for improvement over the prior art is that the desired controller should use rule-based control in order to minimize computational requirements. Next, recognizing that compensating inflows may be segregated as flow-compensating and volume-compensating, substantial simplification could be realized if the inflow were treated by the controller as two separate actions.

If pool inflows could be determined by their flow rate as opposed to a change in inflow based on inflow gate leaf position, further accuracies, and economy of computational effort, would accrue to a controller which utilized such a methodology. More significantly, if pool inflows are controlled, then the pools of the canal are in effect hydraulically de-coupled, so that each pool behaves independently.

If demand changes were transmitted electronically, several additional benefits would accrue. First the delay time inherent in wave travel time would be obviated. From this it follows that the controller computational effort could be greatly simplified. By electronically transmitting demand changes, the several pools of the canal can be controlled separately. Because the controller could then concentrate on attaining and maintaining control of one pool in the canal at a time, such control becomes a real feasibility. It follows then that if control of each pool of the canal is realized, control of the canal as a whole must ensue: i.e., each pool is de-coupled hydraulically, independently controlled, and in essence re-coupled electronically.

The ideal canal controller should include a methodology whereby the difficulty of controlling any given pool is determinable. Finally, an ideal pool controller should be implementable on existing sloping top canals without expensive rebuilding of those canals.

SUMMARY OF INVENTION

The present invention teaches a method for the automated control of irrigation distribution canals, and an apparatus to practice that method. More specifically, the present invention provides a method and apparatus to make demand-driven, downstream-controlled variable water deliveries practical for canals. Such canals include, but are not limited to, irrigation distribution canals. Furthermore, the principles of the present invention are applicable to many fluid delivery systems having a free surface, whether the fluid is conveyed in canals, pipes, conduits, culverts or other fluid or bulk-goods transport means well known to those skilled in the art.

The present invention is implemented on each pool of the canal, and each pool is controlled separately. While the following summary concentrates on the implementation of the present invention on one pool of a canal, hereafter referred to as the present pool, by similarly controlling each of the canal's pools the present invention attains and maintains control over the entire canal.

The present invention comprises at least one, and preferably a plurality of, water level sensors placed along the length of the pool, and each of the sensors is connected to a computer. The sensors, and the spacing therebetween, geometrically divide the pool's overall volume into logical volume segments or prisms. The volume of the pool is the sum of these individual volume prisms. The connection between the sensors and the computer may be via a multiplexer through an analog-to-digital converter and thence to the computer.

The computer, analog-to-digital converter, and multiplexer may be implemented as separate units, or as a special purpose pool control unit incorporating any combination of these functions. Implemented on the computer is a control program referred to hereafter as the pool controller. The pool controller has two main components. At the primary level, the pool controller's volume controller maintains the pool's setpoint target depth using pool volume control. At the secondary level, and subordinate to the volume controller, the pool controller's gate flow controller maintains pool flow control at the pool's inflow gate. This is accomplished by means of position control of the inflow gate leaf.

The present pool computer is connected to the computers controlling the pools, if any, immediately upstream and downstream of the present pool. This connection may be via wires, cables, radio link, microwave, optical signal or other signal transmission means well known to those skilled in the art. Furthermore, the present invention specifically contemplates implementation on one computer operating the pool controller of the present application on each pool of the canal sequentially by means of multi-tasking, multi-programming, time sharing or other computational resource sharing methodology well known to those skilled in the art.

The present invention utilizes a setpoint as a reference for control of the pool. Each pool has one setpoint having a specific location, and an associated setpoint target depth, i.e. the depth of the pool at the setpoint which the system will attempt to maintain. Generally, the setpoint is at the downstream end of the canal. The setpoint target depth is typically equal to or greater than the normal depth of water at the setpoint when the canal is operating at its design flow rate. Finally, each setpoint has an actual or measured depth.

For any setpoint target depth for a given pool, there is a corresponding fixed relationship between pool throughflows and pool volumes for that pool. Because throughflow through the pool defines the volume required to maintain the setpoint target level, the present invention teaches that a change in demand requires two separate and independent compensating actions. Clearly, a change in the inflow is required to offset the actual change in demand. This change in inflow is termed herein flow compensation. Additionally, if somewhat less obviously, a change to the pool's volume, reflecting the change in throughflow, is also required to maintain the setpoint target depth. This change in volume is termed herein volume compensation. The present invention maintains the setpoint target level of the pool by controlling gate flows and pool volumes separately. Because pool volumes determine pool levels in the steady state condition, flow management is subordinate to volume management in the methodology taught by the present invention.

The present invention attains and maintains pool level control indirectly by means of pool volume control, i.e. by controlling the pool volume where the flow is known. In other words, for a given flow through a given pool, the pool's volume determines the water level at the setpoint location in a steady state condition. Accordingly, changes in throughflow require changes to the pool's volume in order to maintain setpoint target depth. These changes are termed herein compensating volumes. The control of the pool's volume is implemented by flow control at the inflow gate to provide the compensating volumes. To implement volume control, a table is calculated for each pool of flow versus volume for a given setpoint target depth. This flow-versus-volume table or database is embodied in the pool controller. By using this flow-versus-volume table, given a constant setpoint level (i.e. target depth) and a variable pool flow, the volume required to maintain the pool's setpoint target level is made known for any given flow.

Level measurements are made, and control actions performed by the apparatus of the present invention at regularly scheduled intervals termed herein time steps. The use of time steps precludes over-controlling the canal.

In the case of downstream control, pool controllers according to the present invention are invoked at each time step, one at a time, starting at the most downstream pool and proceeding to the first pool below the canal headworks. In this way demand changes and other pertinent information are accumulated in the proper order.

The operation of a pool control apparatus constructed according to the principles of the present invention is summarized as follows:

At a time step subsequent to a change in the pool's demand, the water-level sensors disposed along the length of the pool sense the change in water level caused by the change, and transmit this water level data to the pool controller.

The volume controller operates as a computational loop. First, the pool controller's volume controller, receiving the level data from each of the sensors, uses the data to compute the volume of each prism, using pool cross-sectional data previously stored in the computer. The volume controller then sums the several prisms to determine the overall volume of the pool.

After the volume controller determines the current pool volume, it invokes the gate flow controller to determine the flow through the inflow gate: i.e., the pool inflow. Next it receives similar data from the gate flow controller immediately downstream to determine the current pool's outflow, and recalls the pool's historical volume. Pool inflow has two components: demand inflow and compensating volume inflow. The historical volume is the current pool volume from the preceding time step which was previously stored in the computer's memory. From these data, the volume controller calculates the pool's demand.

The volume controller utilizes travelling means, deadbands and an event filter to extract demand change data from the water level data from the sensors. The travelling mean serves as a low pass filter. The deadband insures that any remaining numerical noise in the level data is ignored. The event filter works in conjunction with nested levels of traveling mean and deadband combinations. This allows the pool controller to respond immediately to large changes (events) in demand, but to delay responses to smaller demand changes when interference exists with proper data detection.

Next, the volume controller gets the historical demand and calculates the demand change for the present pool. Like the historical pool volume, the historical demand is the pool's demand at the preceding time step. The difference between the demand and the historical demand is the pool's demand change. The controller then receives from the previous pool's controller, i.e. the controller of the pool immediately downstream, the demand changes from the previous pool and any pools downstream from it. From these data the volume controller then calculates the total demand change for the current pool and all pools previous, i.e. downstream, thereto.

After summing the demand changes, the volume controller then updates the target pool inflow to reflect the demand inflow given the new inflow and computes the required volume for the current pool.

Next, the volume controller calculates the compensating pool volume for the current pool, i.e. the difference between actual and required pool volumes, gets the sum of all downstream compensating volumes from the previous pool and calculates the sum of compensating volumes in the current and previous, or downstream pools. The volume controller then determines if the sum of the compensating volumes is approaching zero.

If the sum of compensating volumes approaches zero, or has a negative value, the volume controller sets the volume compensating inflow to zero. Where the sum of compensating pool volumes has a negative value, this is indicative that current and downstream pool volumes are excessive relative to the throughflow. In this case the volume controller ramps the volume compensating inflow to a negative value and allows demand to reduce the excess volume. Where the sum of compensating inflows has a positive value, the reverse is true and the volume controller ramps the volume compensating pool inflow to a maximum value over time. After the volume compensating inflow is calculated, it is summed with the previously calculated demand inflow and the resultant updated pool inflow requirement sent to the gate flow controller, which being invoked by the volume controller, adjusts the gate opening to provide the required pool inflow.

A noteworthy feature of the present invention is that while data is collected from pools immediately adjacent to the pool under control, the pool controller takes no control action whatsoever on any pool but the one pool which it controls. In the case where one computer operates a plurality of pool controllers as previously discussed, no control action is taken on any pool but the one pool whose controller is currently being executed.

The gate flow controller operates a physical gate. In the case of irrigation canals such gates typically comprise an adjustable, rectangular orifice. Other gates include, but are not limited to valves of various designs, as well as any of numerous mechanical or electro-mechanical devices by which the flow of liquids or loose materials may be started, stopped or regulated by a movable part which opens, shuts or partially obstructs one or more transmission means. The gate flow controller adjusts the gate opening to maintain the pool inflow requirement specified by the volume controller.

A pool controller constructed according to the principles of the present invention and which provides downstream control, loops through all the canal pools in a reverse sweep starting at the tail end of the canal, and knowledge of demands is accumulated in the upstream direction, until the total demand is imposed at the canal headworks. The sum of demand changes for all pools downstream as well as the sum of compensating volumes for all pools downstream are sent from the previous controller (i.e., the controller immediately downstream) to the pool controller of the present pool. The present pool controller then adds to these two values the demand change and compensating volume for the present pool and transmits these updated values to the next controller upstream. Every pool's inflow is therefore shown to be responding not only to changes of demand within the pool itself, but also to the sum of demand changes and compensating volume changes for the entire canal below it. In this manner, knowledge of downstream conditions is transmitted electronically, rather than hydraulically to the upstream pools and the headworks. This eliminates the delays imposed by hydraulically coupled systems which rely on wave travel to transmit demand and/or volume changes along the canal.

The control methodology taught by the present invention includes a feedback loop which allows the controller to adapt to drift in system parameters and to inaccuracies in system models, as well as changes in demands.

In order to overcome discrepancies between gate leaf position and gate flow rates, the gate flow controller of the present invention implements flow control at inflow gates, rather than gate leaf position control as a means for determining the amount of water input into a given pool. The control action required is not the gate leaf position, but the flow through the gate. This flow control presents several advantages. First, the system is never out of control concerning gate flows. Second, gate flow control is automatically insulated from the effects of adjacent turnouts. Third, gate flow control can be subservient to pool volume control in a logically consistent manner. Because flow control as implemented in the present invention has the effect of hydraulically de-coupling the several pools of the canal it enables the previously discussed advantages of controlling each pool independently from the other pools in the canal. Note that, as stated previously, the pools are recoupled electronically in a manner by which the entire canal is under control.

In use, the present invention enables the user to simply open a turnout when water is needed, and to close it when no longer needed. The method and apparatus taught herein then cause the canal to respond such that flow increases are automatically scheduled in the upstream direction from the delivery point to the canal headworks. The headworks then responds by providing additional flow to compensate for the additional demand. In like fashion, when a demand is terminated, the method and apparatus taught herein cause the canal to respond with flow decreases in the upstream direction from the rejection point to the headworks. The headworks then responds with reduced flow to compensate for the decreased demand.

The principles of the present invention are applicable over a wide range of applications (i.e., a broad design envelope) and may be implemented with either the previously discussed semi-local control or with global control. Most particularly, the concepts of pool volume control and gate flow control as presented herein are not limited to the downstream control implementation heretofore discussed. These concepts provide a valuable and reliable means of implementing any canal control scheme, and are particularly suitable for customized, non-standard control schemes which may well be the future of canal control. Locally based controllers, using the principles of the present invention, can provide downstream control for an entire canal. Similarly, the present invention enables globally based controllers to allow both upstream and downstream control, whereby deliveries may be initiated either from the headworks or the delivery point.

The canal control methodology described above utilizes level measurements only with no direct flow measurement. This is due to the fact that direct flow measurement is, at this time, both expensive and difficult to implement in open canals. It will however be immediately apparent to those skilled in the art that the principles of the present invention may, with equal facility be implemented in canals using direct flow measurement, and such implementation is specifically comprehended by the invention taught herein.

Other features of the present invention are disclosed or apparent in the section entitled: "BEST MODE FOR CARRYING OUT THE INVENTION."

BRIEF DESCRIPTION OF DRAWINGS

For fuller understanding of the present invention, reference is made to the accompanying drawing in the following detailed description of the Best Mode of Carrying Out the Invention. In the drawing.

Figure 1:
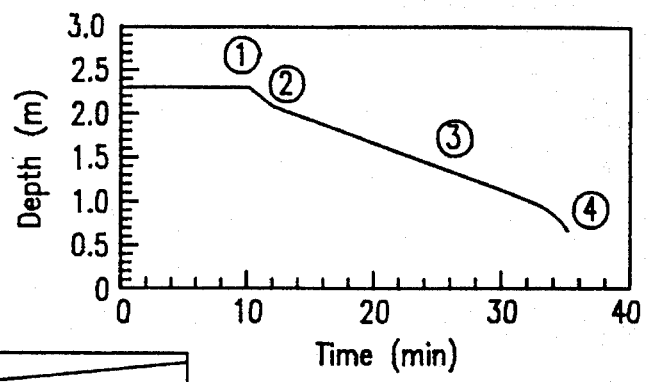
FIG. 1 is a pool surface level at the pool's downstream end, showing an uncompensated demand over time.
Figure 2:
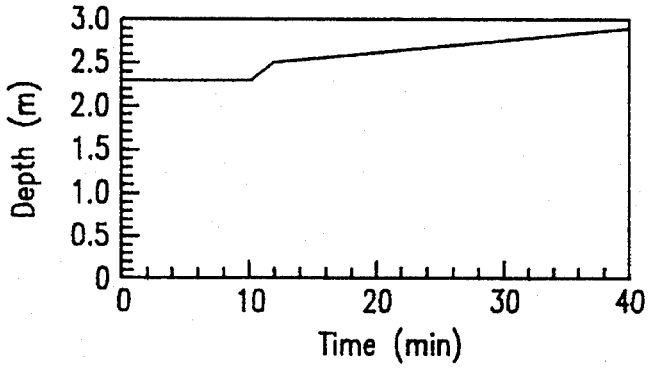
FIG. 2. is a pool surface level at the pool's downstream end, showing an uncompensated rejection over time.
Figure 3:
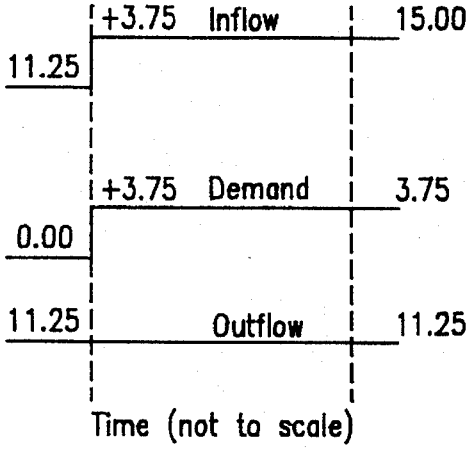
FIG. 3. is a hydrograph showing an increase in demand met with a flow-compensating inflow.
Figure 4:
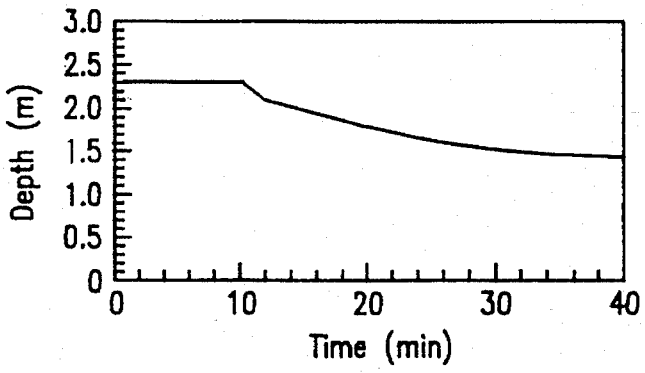
FIG. 4. is a pool surface level at the pool's downstream end, showing an increase in demand met with a volume-compensating inflow.
Figure 5:
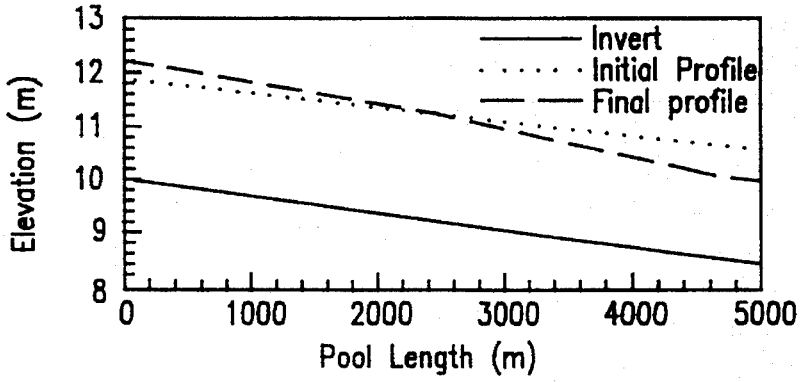
FIG. 5. is a pool surface profile pivoting with additional throughflow.
Figure 6:
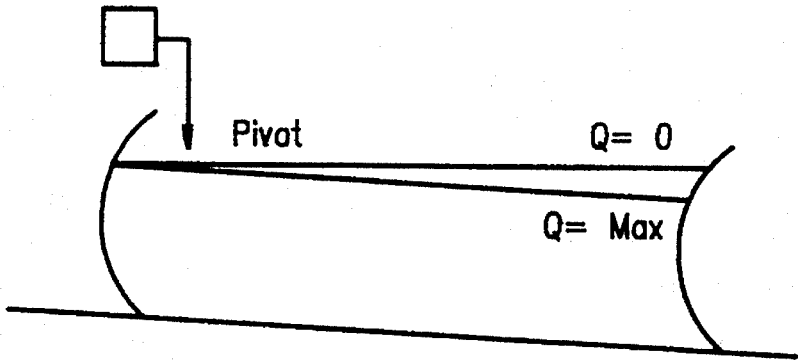
FIG. 6. is a pool surface profile of a pool with an upstream setpoint pivoting with changes in throughflow.
Figure 7:
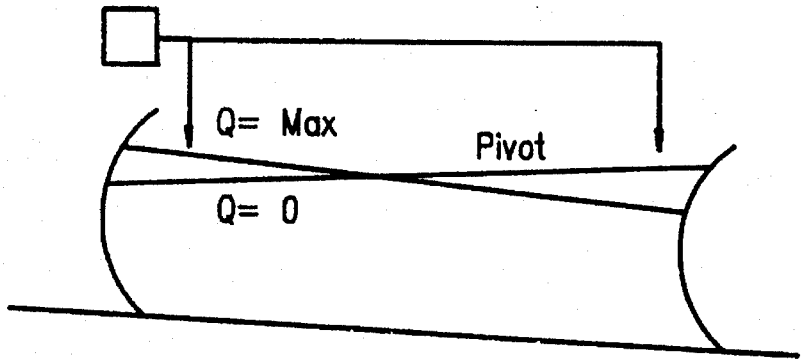
FIG 7. is a pool surface profile of a pool with a midstream setpoint pivoting with changes in throughflow.
Figure 8:
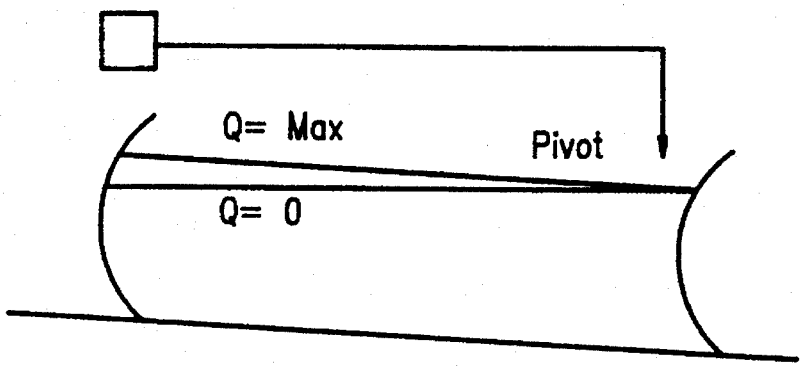
FIG. 8. is a pool surface profile of a pool with a downstream stream setpoint pivoting with changes in throughflow.
Figure 9:
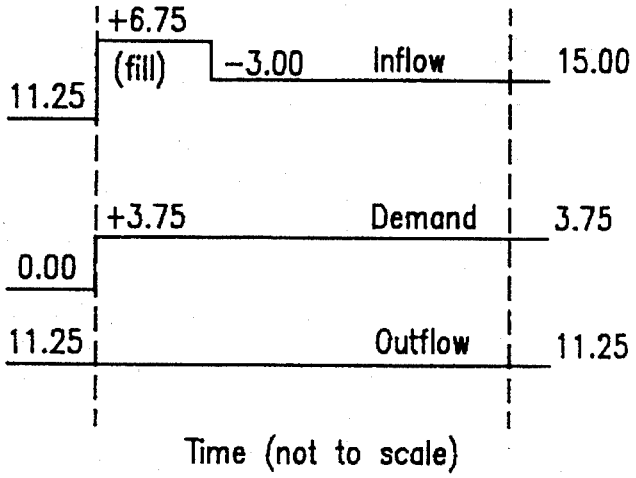
FIG. 9. is a hydrograph of a pool which is compensated both for flow and volume following an increase in demand.
Figure 10:
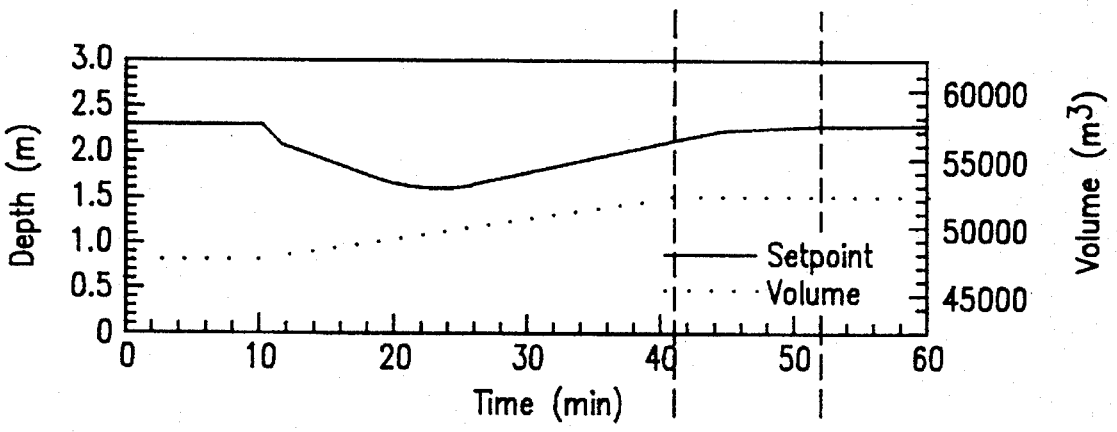
FIG. 10. is pool surface level at the pool's downstream end, a of a pool which is compensated both for flow and volume, following an increase in demand.
Figure 11:
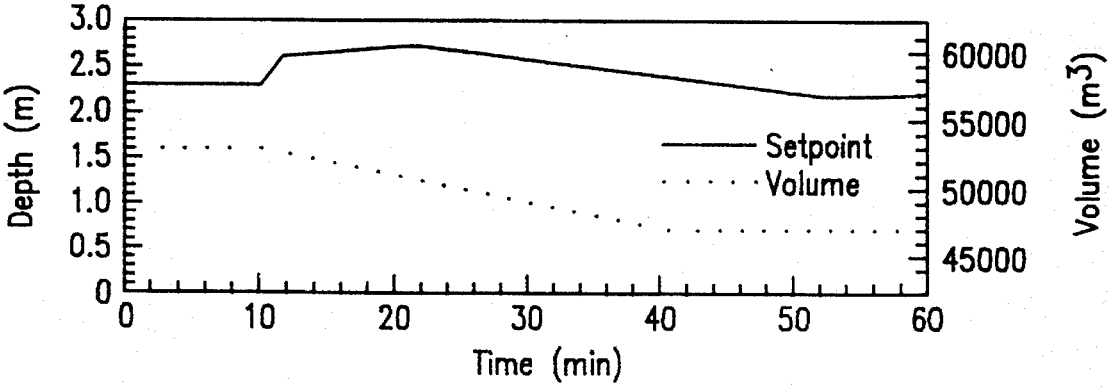
FIG. 11. is pool surface level at the pool's downstream end, a of a pool which is compensated both for flow and volume, following a rejection.

Reference numbers refer to the same or equivalent parts of the present invention throughout the several figures of the drawing.

BEST MODE FOR CARRYING OUT THE PRESENT INVENTION

The control methodology taught by the present invention ensures that each pool of the canal is maintained at its setpoint target level at all times, each pool acting much like a reservoir, with water limited only by the canal's maximum flow less the sum of the upstream demand. The control methodology, and an apparatus to practice that methodology are easily and economically implementable on a wide variety of existing canal systems, including canals with sloping tops.

This methodology taught herein is rule-based and utilizes a feedback loop for adapting to changing conditions and for correcting errors in controller performance.

The present invention uses flow control, as opposed to direct control of the gate leaf position, as a means for determining the amount of water input into a given pool. This has the effect of hydraulically de-coupling the several pools of the canal, thereby enabling the previously discussed advantages of controlling each pool independently from the other pools in the canal, then re-coupling them electronically.

The present invention utilizes a setpoint as a reference for control of the pool. While the succeeding discussion relates to the implementation of a downstream setpoint, the principles of the present invention are equally applicable to setpoints at other locations within the pool.

The sensors of the apparatus taught herein further geometrically divide the pool volume into logical volume segments or prisms. The geometrical boundaries of the volume prisms are: the water's surface, the pool invert, the sides of the canal and the lines perpendicular to the axis of the pool, and which are defined by the sensor locations. The volume of the pool is therefore seen, at any time, to be the sum of these individual volume prisms.

The underlying principle of the present invention is that of achieving and maintaining a steady state operation in each pool. Given such a steady state, and for a given flow through the pool, there is a unique setpoint volume associated with the setpoint target depth established at the downstream end of the pool. The control objective of the present invention is to maintain the setpoint target depth at a constant level. This is done by controlling the volume, where the flow is known. For each pool, a table is calculated of flow versus volume for a given setpoint depth. Using this table, given a constant setpoint target level and a variable pool flow (Q), the volume (Vol) of a pool is made known. If the setpoint target level is to vary, then the table must have another dimension to accomplish this.

The present invention maintains the setpoint target level of the pool by controlling gate flows and pool volumes separately. Because a pool's volume determines its level in the steady state condition, flow management is subordinate to volume management in the methodology of the present invention. There are therefore two tiers, or control levels in the control hierarchy taught by the present invention. This is reflected in the design of the pool controller, which has two main components. At the primary tier, the pool controller's volume controller maintains the pool's setpoint target depth using pool volume control as previously discussed. At the secondary tier in the control hierarchy, and subordinate to the volume controller, the pool controller's gate flow controller maintains pool flow control at the pool's inflow gate, thereby ensuring that the inflow required to meet existing demands is maintained. This is accomplished by means of position control of the inflow gate leaf.

Control inputs and outputs are operated according to a schedule to ensure that the pools of the canal are neither over- nor under-controlled. This schedule ensures that control inputs are taken, necessary computations made, and control outputs made at precisely scheduled intervals called time steps.

Because the volume of a pool changes with the flow through that pool, a change in a pool's demand, and hence flow from one time step to the next creates a change in the volume of each prism of the pool. The volume controller, receiving level data from each sensor or other sensor in the pool, uses this level data to compute the volume of each prism. For this reason, pool cross-sectional data unique to each pool is stored in the computer as a table, database or other data storage structure well known to those skilled in the art. In operation, the volume controller sums the several prisms to determine the volume of the entire pool.

The operation of the present invention is summarized as follows: At a time step subsequent to a change in the pool's demand, the water-level sensors disposed along the length of the pool sense the change in water level caused by the change, and transmit this water level data to the pool controller.

The volume controller operates as a computational loop. First, the pool controller's volume controller, receiving the level data from each of the sensors, uses the data to compute the volume of each prism, using pool cross-sectional data previously stored in the computer. The volume controller then sums the several prisms to determine the overall volume of the pool.

After the volume controller determines the current pool volume, it invokes the gate flow controller to determine the flow through the inflow gate: i.e., the pool inflow. Next it receives similar data from the gate flow controller immediately downstream to determine the current pool's outflow, and recalls the pool's historical volume. Pool inflow has two components: demand inflow and compensating volume inflow. The historical volume is the current pool volume from the preceding time step which was previously stored in the computer's memory. From these data, the volume controller calculates the pool's demand.

The volume controller utilizes travelling means, deadbands and an event filter to extract demand change data from the water level data from the sensors. The travelling mean serves as a low pass filter. The deadband insures that any remaining numerical noise in the level data is ignored. The event filter works in conjunction with nested levels of traveling mean and deadband combinations. This allows the pool controller to respond immediately to large changes (events) in demand, but to delay responses to smaller demand changes when interference exists with proper data detection.

Next, the volume controller gets the historical demand and calculates the demand change for the present pool. Like the historical pool volume, the historical demand is the pool's demand at the preceding time step. The difference between the demand and the historical demand is the pool's demand change. The controller then receives from the previous pool's controller, i.e. the controller of the pool immediately downstream, the demand changes from the previous pool and any pools downstream from it. From these data the volume controller then calculates the total demand change for the current pool and all pools previous, i.e. downstream, thereto.

After summing the demand changes, the volume controller then updates the target pool inflow to reflect the demand inflow given the new inflow and computes the required volume for the current pool.

Next, the volume controller calculates the compensating pool volume for the current pool, i.e. the difference between actual and required pool volumes, gets the sum of all downstream compensating volumes from the previous pool and calculates the sum of compensating volumes in the current and previous, or downstream pools. The volume controller then determines if the sum of the compensating volumes is approaching zero.

If the sum of compensating volumes approaches zero, or has a negative value, the volume controller sets the volume compensating inflow to zero. Where the sum of compensating pool volumes has a negative value, this is indicative that current and downstream pool volumes are excessive relative to the throughflow. In this case the volume controller ramps the volume compensating inflow to a negative value and allows demand to reduce the excess volume. Where the sum of compensating inflows has a positive value, the reverse is true and the volume controller ramps the volume compensating pool inflow to a maximum value over time. After the volume compensating inflow is calculated, it is summed with the previously calculated demand inflow and the resultant updated pool inflow requirement sent to the gate flow controller, which being invoked by the volume controller, adjusts the gate opening to provide the required pool inflow.

A noteworthy feature of the present invention is that while data is collected from pools immediately adjacent to the pool under control, the pool controller takes no control action whatsoever on any pool but the one pool which it controls. In the case where one computer operates a plurality of pool controllers as previously discussed, no control action is taken on any pool but the one pool whose controller is currently being executed.

The gate flow controller operates a physical gate. In the case of irrigation canals such gates typically comprise an adjustable, rectangular orifice. Other gates include, but are not limited to valves of various designs, as well as any of numerous mechanical or electro-mechanical devices by which the flow of liquids or loose materials may be started, stopped or regulated by a movable part which opens, shuts or partially obstructs one or more transmission means. The gate flow controller adjusts the gate opening to maintain the pool inflow requirement specified by the volume controller.

A pool controller constructed according to the principles of the present invention and which provides downstream control, loops through all the canal pools in a reverse sweep starting at the tail end of the canal, and knowledge of demands is accumulated in the upstream direction, until the total demand is imposed at the canal headworks. The sum of demand changes for all pools downstream as well as the sum of compensating volumes for all pools downstream are sent from the previous controller (i.e., the controller immediately downstream) to the pool controller of the present pool. The present pool controller then adds to these two values the demand change and compensating volume for the present pool and transmits these updated values to the next controller upstream. Every pool's inflow is therefore shown to be responding not only to changes of demand within the pool itself, but also to the sum of demand changes and compensating volume changes for the entire canal below it. In this manner, knowledge of downstream conditions, including pool demand changes and pool volume surpluses and deficiencies, is transmitted electronically, rather than hydraulically to the upstream pools and the headworks. This eliminates the delays imposed by hydraulically coupled systems which rely on wave travel to transmit demand and/or volume changes along the canal.

The control methodology taught by the present invention includes a feedback loop which allows the controller to adapt to drift in system parameters and to inaccuracies in system models, as well as changes in demands.

In order to overcome discrepancies between gate leaf position and gate flow rates, the gate flow controller of the present invention implements flow control at inflow gates, rather than gate leaf position control as a means for determining the amount of water input into a given pool. The control action required is not the gate leaf position, but the flow through the gate. This flow control presents several advantages. First, the system is never out of control concerning gate flows. Second, gate flow control is automatically insulated from the effects of adjacent turnouts. Third, gate flow control can be subservient to pool volume control in a logically consistent manner. Because flow control as implemented in the present invention has the effect of hydraulically de-coupling the several pools of the canal it enables the previously discussed advantages of controlling each pool independently from the other pools in the canal. Note that, as stated previously, the pools are recoupled electronically in a manner by which the entire canal is under control.

Figure 12:
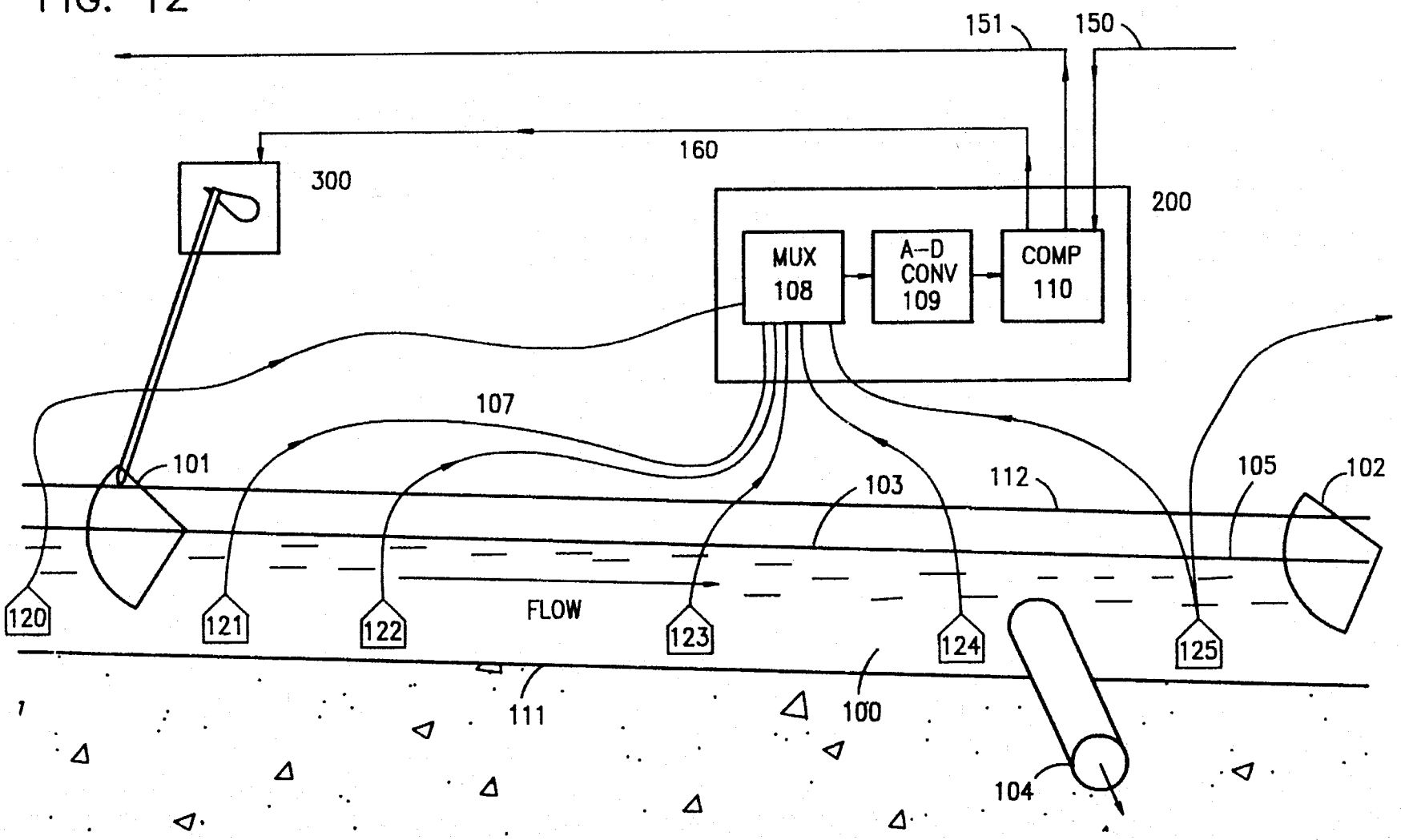
FIG. 12. A sectional profile of one pool of a multi-pool canal having an apparatus according to the principles of the present invention implemented thereon.

Referring now to FIG. 12, one embodiment of the best mode for carrying out the present invention is detailed as implemented on one pool 100 of a multi-pool canal. The pool is bounded the upstream end by the inflow gate leaf 101, at the downstream end by the inflow gate leaf 102 of the pool immediately downstream from pool 100, and on the bottom by the pool floor or invert 111. In this vertical section view, the water surface profile, or level, is shown at 103. A turnout, 104, is shown at the downstream end of the pool, near the setpoint 105. A series of water level sensors 121–125 are placed at various locations along the length of pool 100. The final downstream water level sensor in the pool immediately upstream is shown at 120. Any well known continuous level sensing apparatus are capable of fulfilling this function. By way of example, but not limitation, these apparatus include: pressure, float, conductivity, dielectric variation, sonic and radiation sensors. In the preferred embodiment, continuous level sensors are of the pressure type, specifically Honeywell/MicroSwitch Model 140PC sensors, are utilized.

Each sensor 120–125 is connected via wiring 107 to a multiplexer 108. Multiplexer 108 receives the signals from each of sensors 120–125 and transmits that signal to an analog-to-digital converter 109. Analog-to-digital converter 109 is operatively associated with a computer 110, and converts the analog water level signals from the sensors to digital data usable by computer 110.

In the preferred embodiment of the present invention, a TescoFlex Liquitronic-4 control unit, specifically Model 70-001-20-00-3-04-A, available from Tesco Inc., 3434 52nd Avenue, Sacramento, Calif. 95823 is connected to sensors 120–125 and reprogrammed according to the principles of the present invention. This unit, shown as 200 in FIG. 12, combines the computer, analog-to-digital converter, and multiplex functions into one unit. Alternatively, a general purpose, programmable digital computer may be used with many analog-to-digital converters and multiplexers well-known to those skilled in the art. In developing the present invention, the programmatic elements thereof were implemented using the FORTRAN-77 language on an IBM-compatible microcomputer.

The programmatic elements of the present invention may eventually be implemented as specially programmed software, "firmware", or in a specially programmed hardware unit, such as an EPROM.

Demands are detected by means of the series of water level sensors 121–125 along the length of the pool, as changes in water levels. The levels define the volume of the several prisms of the pool which are summed to form the pool volume.

The sum of downstream demand inflow changes and the sum of downstream compensating inflows is transmitted to control unit 200 by means of wiring 150 from the control unit (not shown) of the pool immediately downstream from the present pool. Similarly, the sum of the present pool and downstream demand inflow changes and the sum of the present pool and downstream compensating inflows is transmitted from the present pool control unit to the control unit (not shown) of the pool immediately upstream by means of wiring 151.

Level information from sensors 120 and 121 are used by control unit 200 to compute inflows, as will be discussed later. Similarly, sensor 125 and the first sensor (not shown) of the pool immediately downstream from the present pool are used by the pool controller of the downstream pool to calculate inflows for that pool, which are also equivalent to outflows from the present pool.

After receiving level data from each of sensors 120–125, the pool control unit of the present invention first determines the flow through the canal. Then the pool control unit calculates the compensating volume of the present pool and all pools downstream, and a corresponding volume compensating inflow of fluid required to maintain the setpoint target level of the present pool and all pools downstream. Next, the pool control unit calculates the compensating flow of the present pool and all pools downstream, and a corresponding demand compensating inflow of fluid required to meet the demands of the present pool and all pools downstream. The pool controller of the present invention then sums the volume compensating inflow and the demand compensating inflow as a target inflow required. The pool controller then translates this target inflow into the specific gate position instruction required to enable the target inflow to inflow gate operating mechanism 300. Finally, the sum of the present pool and downstream demand flow changes and compensating volumes are transmitted over wiring 151 to the pool controller (not shown) of the pool immediately upstream of the present pool.

The following discussion explains the logic behind the pool controller of the present invention. It is known that the derivative of volume with respect to time is to the inflow less the outflow and the demand, or:

The demand is thus seen to be dVol/dt less the difference in gate flow rates at the pool ends. Alternatively, and as previously discussed, the demands could be $$\frac{dVOl}{dt} = (Q_{inflow} - Q_{outflow} - Q_{demand})$$

detected by instrumenting the turnouts with flow measurement sensors, using the measurements thus obtained to read demand directly.

The former approach is taken for several reasons. First, some level sensors are already required in any case for tracking volume. The need for the additional sensors required by the present invention is simply an extension of an existing hardware requirement. Second, the use of level sensors isolates the control system from the end user. By way of an example as to how this benefits the canal operators and users, water can then be pumped from any location using portable ditch pumps, and the canal control system will remain functional. Another example of a benefit accruing from the use of sensors is that they will detect unintended or unauthorized flow diversions due to canal breaks or theft.

There are significant problems to be overcome using an unfiltered value of dVol/dt however. The sensor's ability to resolve differences in water levels has the potential for introducing significant errors in the flow calculations. 3 mm is the best resolution reliably attainable, given the current state of the art in water level sensor technology. In at least one pool, using a level measurement of 1.5 mm (i.e., one half the available resolution of 3 mm), and a one minute time step, there was found to be an error in dVol/dt of 3.45 cms. This is a substantial flow rate. If the error is greater that the changes which must be controlled, the controller will ultimately fail.

In general, digitization of the measurements used to compute volume enters into the accuracy of dVol/dt. There are 3 dimensions to this digitization of volume measurements: the vertical, the longitudinal and time, all three of which must be considered when attempting to obtain an accurate measure of dVol/dt. Regarding the accuracy of the longitudinal dimension, it is desirable for the sake of economy to use as few level sensors as possible.

Given the previously discussed limitations imposed by digitizing the input data, and to implement the present invention with a minimum of computational overhead, dVol is used "as-is", and the volume controller of the present invention utilizes traveling means, deadbands and at least one event filter to extract the needed information about demand changes.

An event filter reads information from sensor input and determines if there are any known events that could generate signal "noise" and impede detection of actual demands. If there are no such events, what the event filter is "seeing" with changes in sensor input are actually changes in demand. A traveling mean is the mean of the volumes for a number of time steps. The traveling mean serves as a low pass filter, and ensures that any remaining numerical noise is ignored. The event filter works in conjunction with nested levels of traveling mean and deadband combinations. This enables the controller to respond immediately to large changes in demand, but to delay responses to smaller demand changes when interference to proper data detection exists.

When physical gates are used to manage the flows at pool ends, a significant amount of noise is introduced which in turn interferes with data interpretation. The event filter, used in concert with a nested hierarchy of travel mean and deadband pairs, allows the controller to interpret data properly in light of recent known events.

Inherent in the selection of traveling means is the use of the correct time step. It has been experimentally determined that time steps of between approximately 0.10 and 60.0 rain are appropriate to the present invention. It is anticipated in most applications, time steps significantly narrower in scope will be utilized, most probably in the range of 1.0 to 15 minutes. In implementing the preferred embodiment on one canal, a time step of 1.0 minutes was found to be optimal.

In implementing the deadband on one pool, a deadband 3.5 times the average observed noise level was utilized. As will be immediately apparent to those skilled in the art, this value may be significantly modified to suit a given application. In one test pool, the 3.5× deadband ensured that the likelihood of signal noise breaching the primary deadband was nil. At any event, the breaching of the deadband with noise is readily observable, and adjustments are easy to implement. Because the purpose of the primary mean/deadband combination is to detect the largest demands as soon as possible, it is used without the event filter.

A secondary mean/deadband combination is applied in conjunction with the event filter. The secondary mean/deadband combination uses the same traveling mean, but a deadband just slightly higher than the observed noise level. Again, in one test pool a deadband value of 1.2 was used. This value may again be modified to suit a given application. As many additional mean/deadband combinations may be used as are deemed necessary for an application where each successive mean/deadband combinations will have increasingly longer traveling means and increasingly smaller deadbands. In one embodiment of the preferred embodiment of the present invention, only two were necessary.

The event filter administers the secondary and all subordinate mean/deadband combinations, each of which in turn allow a determination of the change in demand. When a large change in demand is detected, the event filter will disqualify subsequent use of the more sensitive mean/deadband combinations until it is clear that they will measure an unique event, and not re-respond to the event managed by the primary mean/deadband combination. The event filter also considers noise caused by gate movements and prevents the controller from interpreting these as demands.

Use of an event filter is appropriate in this control environment since smaller demands can wait for their corrective response. That is, subsequent to a small demand change at the end of a pool, it is not imperative that the pool's upstream gate respond immediately to manage the ensuing drawdown in water level. For a large change however, an immediate response is necessary to keep the pool's water levels within their design limits. The event filter is the key to the effective use of the traveling means and deadbands.

At some point, demand changes are so small they can no longer be detected. This is generally acceptable, but it means there will be a drift in pool volume over time. The drift rate will however be so small that the time lag until a volume correction is required will be quite long, hence the likelihood is great that another disturbance will occur before the time required to correct the drift error.

Figure 13:
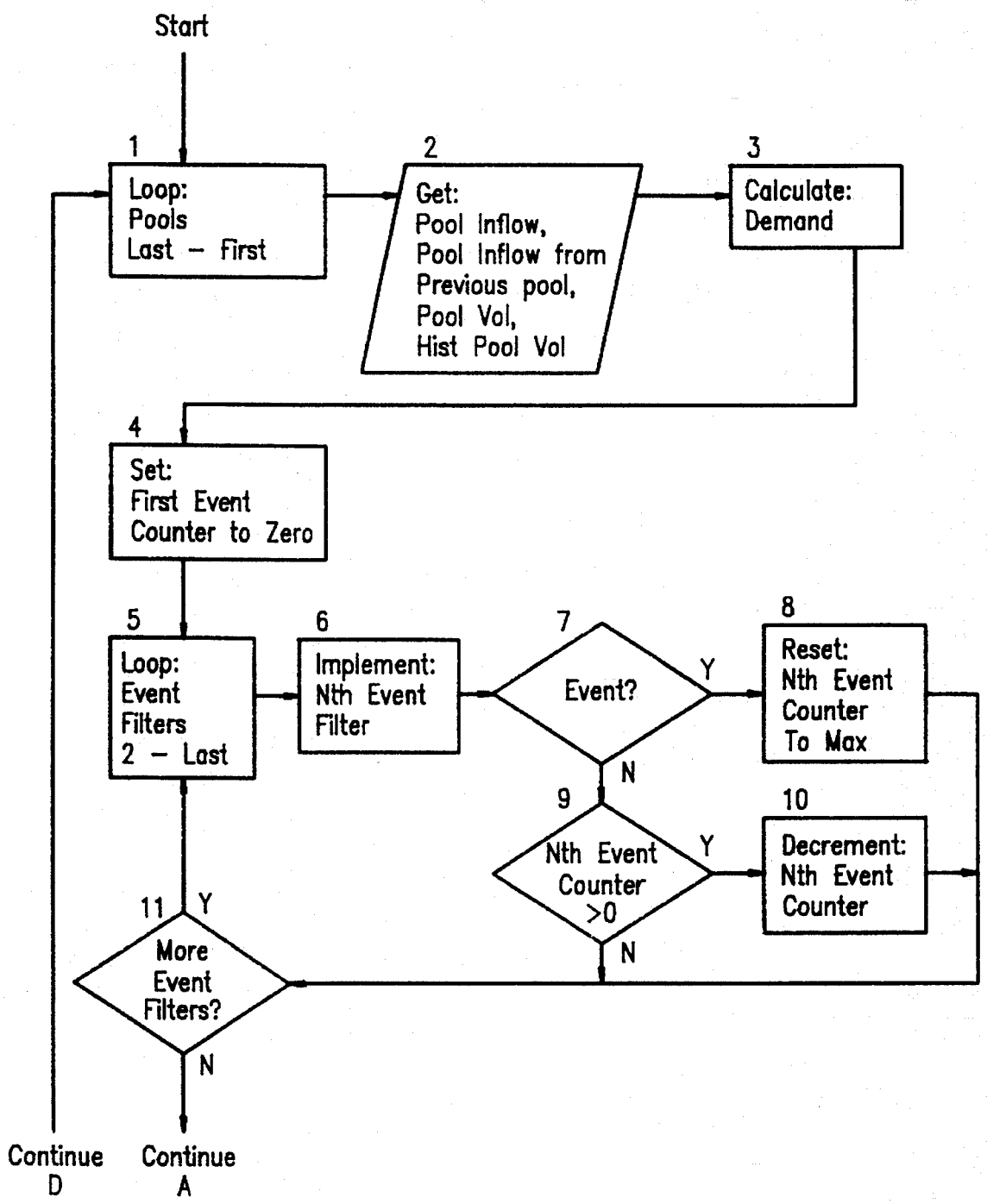
FIGS. 13 through 15 detail the volume controller logic of the present invention.
Figure 14:
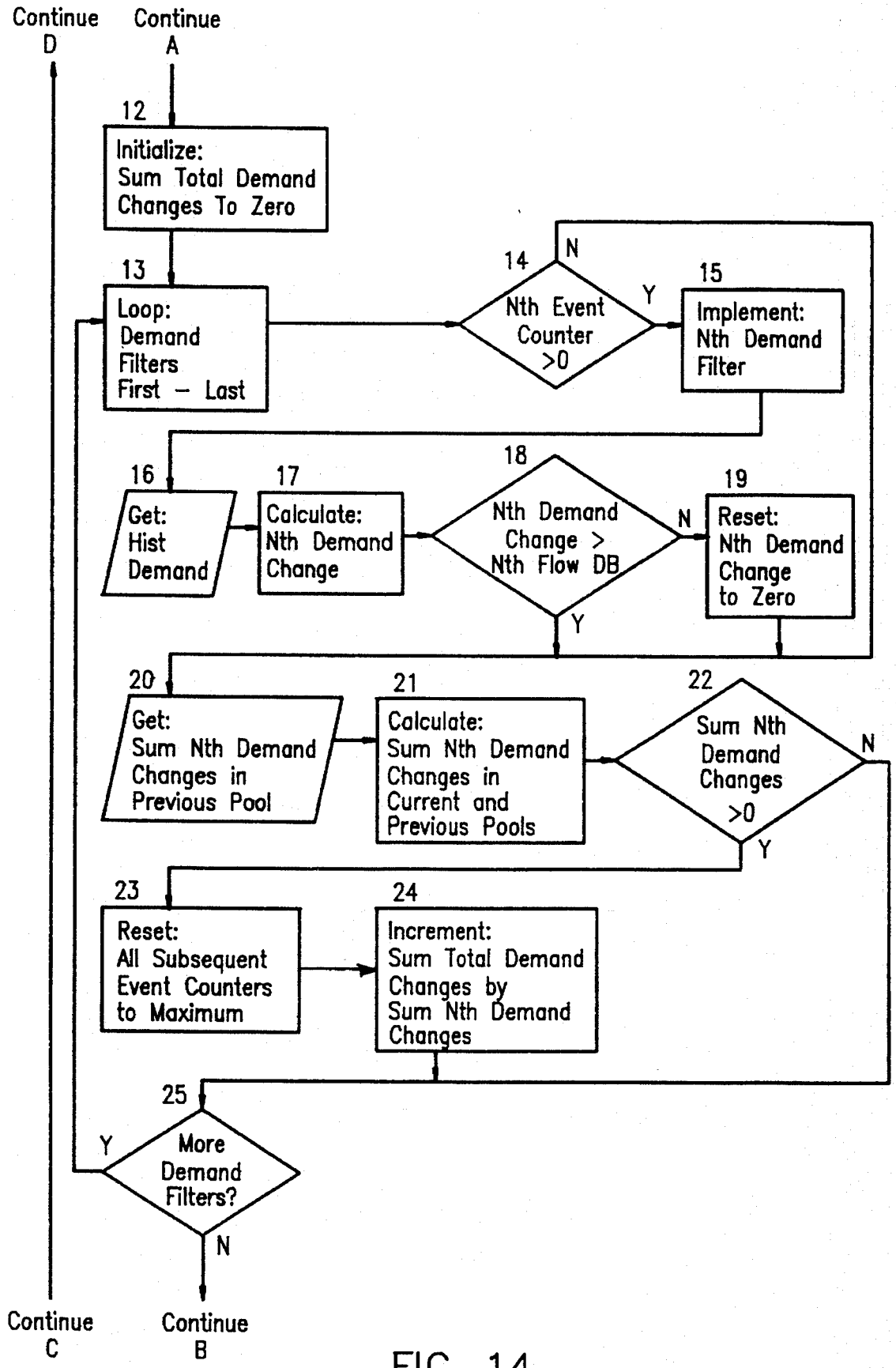
Figure 15:
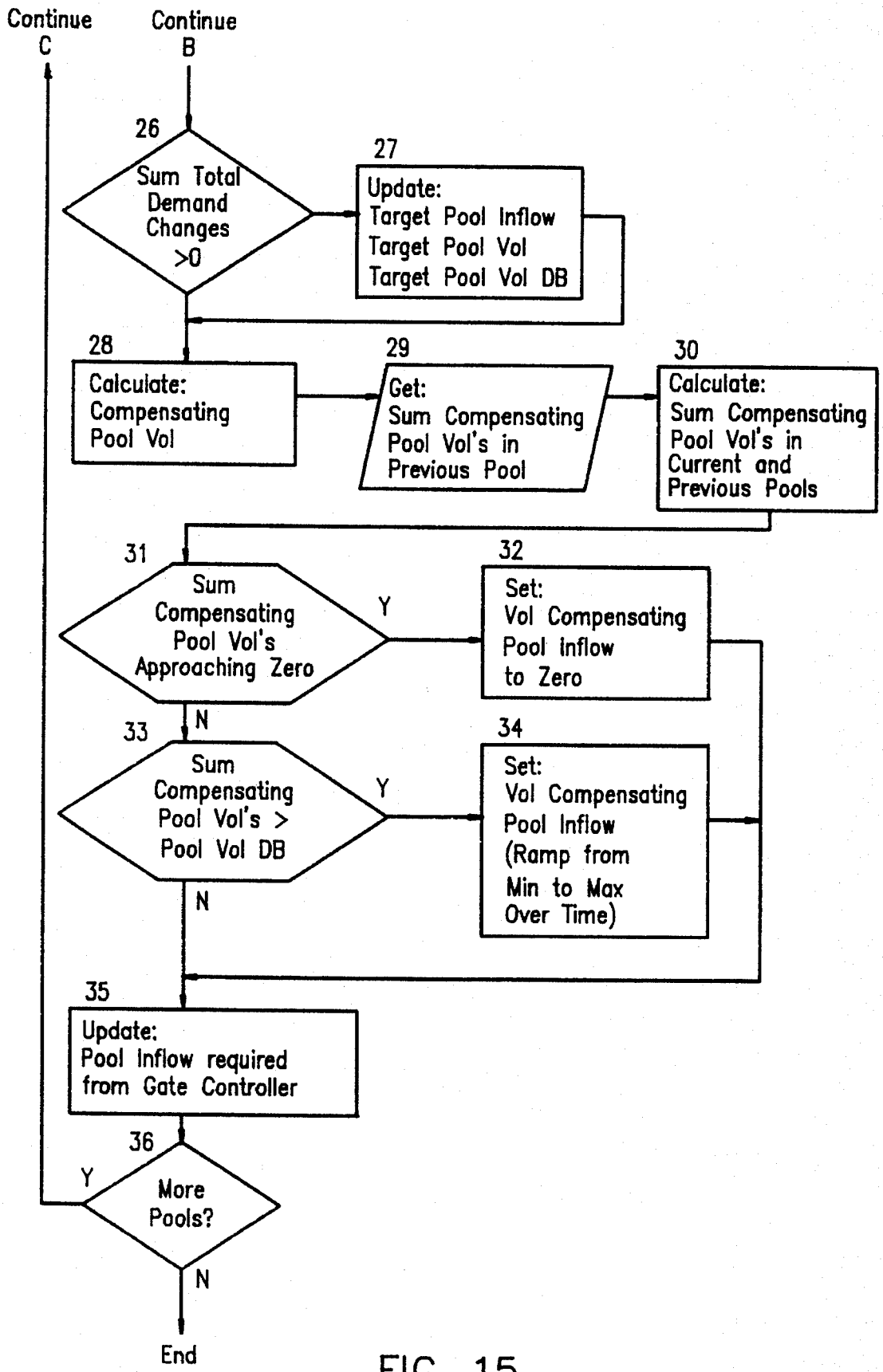

The logic for the pool volume controller is shown in FIGS. 13 through 15, and is described below. Note that in this comprehensive treatment of the volume controller of the present invention, data is viewed as either historical, current or future in scope. Historical data is data from the end of the last time step. Current data includes intermediate calculated values, and future data includes control actions for the next time step.

With reference to FIGS. 13–15, the control logic for implementing the principles of the present invention as a pool volume controller is detailed. At step 1 the system is initiated as a programmatic loop, looping through the pools of the canal in reverse order to flow. In effect, this loop can be thought of as the order in which the separate volume controllers for each pool of the canal are accessed. Each volume controller must execute its control calculations after the volume controller in the previous, downstream pool, since it needs data from the previous pool's volume controller. This ensures that, as stated earlier, data is collected in the upstream direction. Looping in reverse order enables downstream control, the preferred embodiment of the present invention. As an alternative to downstream control, some control situations require upstream control. In these situations, not illustrated herein, the loop order would b in the same direction of flow.

At step 2, the volume controller gets Pool Inflow, Pool Inflow from the Previous Pool, Pool Volume (Vol), and the Historical (Hist) Pool Vol.

At step 3, the volume controller calculates the demand using the information above and the previously discussed relationship between volume and flow:

$$\frac{d\mathrm{VOl}}{dt} = (Q_{inflow} - Q_{outflow} - Q_{demand})$$

At step 4, the volume controller sets the first event counter to zero. This is always done: only the subsequent event counters are subject to the event filters. This means that while there are a number, N, of event filters, there is typically no event counter (or event filter) associated with the first traveling mean/deadband combination in most applications of the principles of the present invention.

At step 5, there being an event counter and an event filter associated with each of the traveling mean/deadband combinations except the first, the volume controller loops through the event filters from second to last.

At step 6, the Nth event filter is implemented.

Step 7 is a decision step. If there is an event, the Nth Event Counter is set to maximum at step 8 and the volume controller passes to step 11. If there is no event, the volume controller executes step 9 which is another decision step.

Step 9 decides if the Nth Event Counter is greater than 0. If so, the Nth event counter is decremented at 10. If not, the volume controller passes to step 11.

The Nth event filter is a logical equation evaluating to either true or false. It evaluates all known events in the pool relative to various deadbands, to see if the Nth filtered demand is measurable given these other disturbances.

If the change in measured inflow is greater than the Nth deadband, or if the change in measured outflow is greater than the Nth deadband, or if the slip in gate flow control (the target flow versus the measured flow) is greater then the gate flow deadband, then an "event" has occurred, and the event filter evaluates to true. The gate flow deadband is constant, and serves to indicate changes in the target flow that cause pool-wide disturbances which render all lower order filtered demands (i.e. all but the first) ineffective.

If an event occurs, then the filtered demand's event counter is set to its maximum value. Since its maximum value is also the number of time steps used by the traveling mean that filters this demand, the event filter insures that the effects of this event will not appear in the Nth filtered demand. For example, if the number of time steps used to calculate the Nth filtered demand is 4 (i.e. the current and three historical demands are summed and divided by 4 to obtain the Nth filtered demand), then when an event occurs and resets the event timer, the Nth filtered demand is disabled for the next 4 time steps. If there are no other events during that interval, then the event counter will "time out" to zero, and the Nth filtered demand will be available to help determine the total demand in the pool with no effect (or very little effect) from the event detected by the event filter.

The intent is that lower order filtered demands should not re-evaluate demands detected by higher order filtered demands; the effect would be to re-measure an already measured value and increment it by the remeasured amount.

At step 11 a decision is made if remaining event filters require processing. If so, the volume controller loops back to step 5. If not, program execution passes to A, detailed in FIG. 14. Referring now to FIG. 14, at step 12, the Sum Total Demand Changes are initialized to 0.

The sum of total demand changes represents the demand measured in the current plus all downstream pools, in the current time step. At this point in the algorithm it is initialized to zero. Depending on the status of the event counters and the status of the sum of filtered demands relative to their respective the deadbands, the sum of the total demand change for the current pool is determined.

At step 13 another loop is established which loops through the demand filters from first to last. Steps 14 through 23 process the demand filters from 1 through N.

Step 14 is a decision step, which determines if the Nth Event Counter=0. If not, execution passes to step 20. If Nth Event Counter is not equal to 0, execution passes to step 15.

If the Nth event counter has not timed out, then skip contributions from the Nth filtered demand from this pool, and look at the sum of Nth filtered demands from downstream pools.

Step 15 implements the Nth Demand Filter. If the Nth event counter has timed out (and remains so), the volume controller calculates the Nth filtered demand. This is the Nth traveling mean of the current and historical demands. For example, if the Nth event counter maximum count is 4, then the Nth traveling mean is the sum of the current demand and three historical (unfiltered) demands, divided by 4. The traveling mean is a simple low pass filter.

After the Nth Demand Filter is implemented at step 15, step 16 gets Hist Demand, after which the volume controller calculates the Nth Demand Change at step 17.

The historical filtered demand represents the filtered demand from the previous time step for the current pool, and can come from any level; i.e. the primary filtered demand, the secondary filtered demand, etc. Only one will survive; e.g. if a secondary filtered demand exists, then lower level filtered demands are not evaluated. Calculate the Nth demand change as the difference between the current Nth filtered demand and the historical filtered demand for the current pool.

Step 18 is a decision step which determines if the Nth Demand Change is greater than the Nth Flow Deadband (DB). If so, execution again passes to step 20. If not, step 19 is executed.

Step 19 resets the Nth Demand Change to Zero.

The Nth filtered demand change must survive the Nth flow deadband, or it is reset to zero. This Nth deadband is the "partner" to the traveling mean used to calculate the Nth filtered demand. As described in a previous section, the flow deadband is significantly larger than the largest deviation of the filtered (measured) value from the actual value. This step insures (practically speaking) filtered demand changes that survive the deadband are not numerical noise but in fact represent a true demand. If the filtered demand change does not survive the deadband, there are two subsequent opportunities for detection. If the actual demand has recently occurred, then perhaps more time steps are required before it emerges from the low pass (traveling mean) filter. If the actual demand is too small to be detected by the Nth demand filter, and there are lower level demand filters available, then it will be detected by them. If the demand is never detected then the demand is very small, and has an absolute magnitude (i.e. approaching zero) which is outside the volume controller's scope of interest.

At step 20, the volume controller gets the sum of the Nth Demand Changes in Previous Pools, after which the program calculates the Sum Nth Demand Changes in Current and Previous Pools (where previous pools are downstream of the current pool, since the pool loop starts from the last pool.) at step 21.

At step 22, it is determined if the Sum Nth Demand Changes are greater than zero. If not, execution passes to step 25. If so, execution proceeds to step 23.

Step 23 resets All Subsequent Event Counters to their maximum value. If there is a demand detected by the Nth demand filter in the current or downstream pools, then the program disables any demand detection in the current pool by means of lower order demand filters.

At step 24, the Sum Total Demand Changes are incremented by the Sum of the Nth Demand Changes, storing the demand changes occurring in the current and downstream pools. This represents the demand change that this volume controller will respond to by changing its inflow, and by targeting a new volume if necessary.

Decision step 25 determines if there are more demand filters which require processing. If so, volume controller execution passes to step 13. If not, execution proceeds to B, discussed at FIG. 15.

Having continuing reference to FIG. 15, decision step 26 decides if the Sum Total Demand Changes are greater that 0. If not, volume controller execution passes to step 28. If so, the Target Pool Inflow, Target Pool Volume, Target Pool Vol Deadband (DB) are updated at step 27.

If there is a demand from the current and/or downstream pools, then the pool volume controller needs to service this demand by changing the pool's inflow and changing the pool's volume. The new inflow is simply the current inflow plus the change in demand. The new volume is a precalculated value, and is determined from a table relating pool volumes with pool inflows and a desired level at the pool's setpoint location. The purpose of the volume deadband is to eliminate noise in volume measurements; its value is also determined from a table.

After the Target Pool Inflow, Target Pool Volume, Target Pool Vol DB are updated at step 27, step 28 calculates the Compensating Pool Vol. Following step 28, step 29 gets the Sum of Compensating Pool Vol's in the Previous Pool, after which the volume controller calculates the Sum of Compensating Pool Vol's in Current and Previous Pools at step 30.

A pool's compensating volume is the difference between its current volume and the target volume as required by the pool's inflow. The volume controller only looks at the sum of compensating volumes for the current pool and all downstream pools; the current pool's compensating volume can be outside the volume deadband, but if it is offset by downstream volumes which are nearly equal in magnitude but opposite in sign, then the volume controller will take no action in this pool. The discrepancy will resolve itself by means of control actions in the downstream pools.

For example, consider a two pool canal segment, where the current pool is the first pool, the first pool is most upstream, the two pools are of equivalent size and shape, and they have large compensating volumes of equal magnitude and opposite sign. Assume also that, for the time being, there are no changes in demand. In spite of the large compensating volume, the current pool's volume controller will take no action; it will issue no volume management command to its gate flow controller at its inlet. The reason is that the gate flow controller in the second, downstream pool will be taking care of this; it will be removing the excess volume in the first pool to supply the second pool's deficiency; there will be no effect on flows upstream of the first pool in this canal segment.

After the volume controller calculates the Sum of Compensating Pool Vol's in Current and Previous Pools at step 30, a determination is made at step 31 if the Sum of the Compensating Pool Vol is Approaching Zero. If not, execution passes to step 33. If so, step 32 is executed.

Step 32 sets the Vol Compensating Inflow to Zero, turning off the pool's volume compensating inflow. After this step, execution passes to step 35.

At step 33, a decision is made as to whether the Sum Compensating Pool Vol's are greater than the value stored in the Pool Vol DB. If not, execution passes to step 35. If so, step 34 is executed.

Step 34 sets the Vol Compensating Pool Inflow. When the pool's compensating volume departs from the volume deadband, the volume controller will turn on the pool's volume compensating inflow, but it will do so gradually so as not to over-commit. This has the effect of ramping inflow to a maximum value over time. The sign of the volume compensating inflow must be correct.

After the Volume Compensating Pool Inflow is set at Step 34, the Pool Inflow required from the Gate Controller is updated at Step 35. The resultant Pool Inflow is sent to the Gate Flow Controller. The new Pool Inflow is thus seen as the sum of the historical pool inflow, the new flow compensating inflow and the new volume compensating inflow.

Finally, at step 36, a determination is made if more pools require processing. If not, the control loop for the current time step ends. If so, control loops back to step 1, shown at FIG. 13.

In order to effect changes to the volume of the pool, the volume controller communicates with the gate flow controller. The gate flow controller portion of the present invention operates the physical gate at the upstream end of pool. While the principles of the present invention are applicable to a wide range of gate geometries, discussed herein will be the implementation of the preferred embodiment of the present invention on a physical gate having an adjustable, rectangular orifice. In the preferred embodiment of the present invention, the gate controller consists of any of a number of P-I-D (proportional-integral-differential) devices well-known to those skilled in the art. Alternatively, a gate controller constructed according to the following discussion may be utilized.

The gate flow controller adjusts the gate opening to maintain the desired inflow prescribed by the pool controller. It has been found that in the comrol of canals, it is not the changing flow requirements which cause control of gates to be marginal: it is the changing head across the gates. From gate mathematics, we know that the flow through a gate is equal to some constant x times the vertical gate opening G times the square root of the head, H, across the gate, or $$Q=xGH^{1/2}$$

If we differentiate this equation with respect to time, acknowledge that dt could be expressed as $\Delta t$ with little loss in accuracy, and finally divide through by $\Delta t$ to eliminate it, we have the following equation:

$$\Delta G = \frac{\Delta Q - 1/2 \times GH^{-1/2}\,\Delta H}{\times H^{1/2}}$$

Note that $\Delta G$ is the future gate opening less the historical gate opening, and similarly for $\Delta H$ and $\Delta Q$, relative to the time step. Since everything here is known, except for the future head H on the gate, we use $\Delta H$ from the previous time step, noting the character of $\Delta H$ described above. During infrequent, mild accelerations of $\Delta H$, this strategy is prone to failure, causing excessive overshoot or undershoot. Accordingly, a relaxation coefficient (between 0.0 and 1.0) is included. The relaxation coefficient is determined empirically.

The gate control procedure is called twice each time step, once before the pool controller is called, and once afterwards. When called before the pool controller, the gate control procedure is used to calculate the flow through the gate. This is then used by the pool controller as the historical inflow. When called after the pool controller, the gate control procedure is used to set the gate opening as required for the target inflow.

As previously mentioned, applying the present invention to a wide range of canals requires inputting some data, generally constants, for each pool to be controlled. Briefly, these data are as follows:

The maximum allowable compensating inflow, determined in light of the maximum allowable drawdown, and the associated maximum allowable demand.

The flow versus target volume table, and flow versus target volume deadband table.

The number of mean/deadband combinations needed, the base durations for each travelling mean, and the flow rate deadbands required for each to detect a demand. The time step duration must also be validated.

The gate flow rate deadband required to detect a significant gate adjustment event which causes system noise, versus a benign gate flow adjustment.

The user must establish reasonable valued for the above constants. This may be accomplished via trial and error using canal simulation software, such as CanalCAD version 1.10, published by the Iowa Institute of Hydraulic Research, The University of Iowa, Iowa City, Iowa 52242-1585.

The present invention has been particularly shown and described with respect to certain preferred embodiments and features thereof. However, it will be readily apparent to those of ordinary skill in the art that various changes and modifications in form and detail may be made without departing from the spirit and scope of the inventions as set forth in the appended claims. The invention illustratively disclosed herein may be practiced without any element which is not specifically disclosed herein. Alternative fluid flow or level measuring devices, controller implementation logic, and signal transmittal and receiving apparatus not identically disclosed herein, are specifically contemplated in canal control methodologies as taught by the present invention.

Finally, while the present invention has been discussed in terms of delivery of irrigation water in open canals, it will be further apparent to those skilled in the art that the principles of the present invention may, with equal facility be implemented on canal and piping systems having free-surface flow and delivering a wide variety of fluids, or fluid-like materials. Such implementations are specifically contemplated by the teachings of the present invention.

I claim:

1. A method for the automated downstream control of a fluid delivery canal, said canal including a plurality of pools, said pools being successively aligned downstream, each of said pools having sides and an invert and being defined by at least one of an upstream inflow gate and downstream outflow gate, and having a setpoint location, said setpoint location having an associated setpoint target depth, said method further for achieving and maintaining steady state operation of said pool despite changing demands and comprising the iterative steps of:

starting with the last pool downstream in said canal, each pool in said canal maintaining its target depth by applying a volume compensating inflow of fluid to the volume of said pool;

starting with said last pool downstream in said canal, each pool in said canal transmitting it's volume compensating inflow upstream to the next pool upstream, said next pool upstream adding it's volume compensating inflow to the sum of downstream volume compensating inflows;

starting with said last pool downstream in said canal, each pool in said canal applying a demand compensating inflow of fluid to said pool to supply sufficient fluid to meet said changing demand; and starting with said last pool downstream in said canal, each pool in said canal transmitting it's demand compensating inflow upstream to said next pool upstream, said next pool upstream adding it's demand compensating inflow to the sum of downstream demand compensating inflows.

2. A method for the automated upstream control of a fluid delivery canal, said canal including a plurality of pools, said pools being successively aligned upstream, each of said pools having sides and an invert and being defined by at least one of an upstream inflow gate and downstream outflow gate, and having a setpoint location, said setpoint location having an associated setpoint target depth, said method further for achieving and maintaining steady state operation of said pool despite changing demands and comprising the iterative steps of:

starting with the first pool upstream in said canal, each pool in said canal maintaining its target depth by applying a volume compensating inflow of fluid to the volume of said pool;

starting with said first pool upstream in said canal, each pool in said canal transmitting it's volume compensating inflow downstream to said next pool downstream, said next pool downstream adding it's volume compensating inflow to the sum of upstream volume compensating inflows;

starting with said first pool upstream in said canal, each pool in the canal applying a demand compensating inflow of fluid to said pool to supply sufficient fluid to meet said changing demand; and starting with said first pool upstream in said canal, each pool in said canal transmitting it's demand compensating inflow downstream to said next pool downstream, said next pool downstream adding it's demand compensating inflow to the sum of upstream demand compensating inflows.

3. A method for the automated hybrid control of a fluid delivery canal, said canal including a plurality of pools, said pools being successively aligned upstream and downstream, each of said pools having sides and an invert and being defined by at least one of an upstream inflow gate and downstream outflow gate, and having a setpoint location, said setpoint location having an associated setpoint target depth, said method further for achieving and maintaining steady state operation of said pool despite changing demands and comprising the iterative steps of:

starting with a given one of said pools, each pool in said canal maintaining its target depth by applying a volume compensating inflow of fluid to the volume of said pool;

starting with said given one of said pools, each pool in said canal transmitting it's volume compensating inflow upstream and downstream to the next pool adjacent, said next pool adjacent adding it's volume compensating inflow to the sum of volume compensating inflows;

starting with said given one of said pools, each pool in the canal applying a demand compensating inflow of fluid to said pool to supply sufficient fluid to meet said changing demand; and starting with said given one of said pools, each pool in said canal transmitting it's demand compensating inflow upstream and downstream to said next pool adjacent, said next pool adjacent adding it's demand compensating inflow to the sum of downstream demand compensating inflows.

4. A method for the automated control of a fluid delivery canal, the method implemented on a control system including a computing device including processing means, memory means, and input/output means, and at least one water level sensing means in operative combination with the computing device, the canal including at least one pool, the pool having sides and an invert and being defined by at least one of an upstream inflow gate and downstream outflow gate, each of the pools having established therefor a setpoint location having an associated setpoint target depth, the method further for achieving and maintaining steady state operation of each of the pools despite changing demands, and comprising the iterative steps for each pool of:

responsive to a change in fluid demand, calculating a demand compensating inflow for the pool with the control system;

further responsive to the change in fluid demand, determining a volume compensating inflow for the pool with the control system;

combining the demand compensating inflow and the volume compensating inflow as a target pool inflow requirement;

translating the target pool inflow requirement into a required opening of the inflow gate;

transmitting the required opening of the inflow gate as an electrical signal over a transmission means to the inflow gate; and responsive to the step of transmitting the required opening, adjusting the opening of the inflow gate to the required opening to provide the target pool inflow requirement;

whereby the demand compensating inflow provides sufficient flow of fluid to compensate for the change in fluid demand and the volume compensating inflow effects the change in pool volume necessary to maintain the setpoint target depth.

5. A method for the automated control of a fluid delivery canal having a plurality of pools, the pools being successively aligned downstream, each of the pools having sides and an invert and being defined by at least one of an upstream inflow gate and downstream outflow gate, and having a setpoint location, the setpoint location having an associated setpoint target depth, the method further for achieving and maintaining downstream control and steady state operation of the canal despite changing demands and comprising the iterative steps of:

starting with the last pool downstream in the canal, applying a demand compensating inflow of fluid to each pool in the canal to supply sufficient fluid to meet the changing demands;

starting with the last pool downstream in the canal, transmitting the demand compensating inflow for each pool in the canal to the next pool upstream, the next pool upstream adding it's demand compensating inflow to the sum of downstream demand compensating inflows;

starting with the last pool downstream in the canal, maintaining the setpoint target depth of each pool in the canal by applying a volume compensating inflow of fluid to the volume of that pool; and starting with the last pool downstream in the canal, transmitting the volume compensating inflow for each pool in the canal to the next pool upstream, the next pool upstream adding it's volume compensating inflow to the sum of downstream volume compensating inflows.

6. A method for the automated control of a fluid delivery canal having a plurality of pools, the pools being successively aligned upstream, each of the pools having sides and an invert and being defined by at least one of an upstream inflow gate and downstream outflow gate, and having a setpoint location, the setpoint location having an associated setpoint target depth, the method further for achieving and maintaining upstream control and steady state operation of the canal despite changing demands and comprising the iterative steps of:

starting with the first pool upstream in the canal, applying a demand compensating inflow of fluid to each pool in the canal to supply sufficient fluid to meet the changing demands;

starting with the first pool upstream in the canal, maintaining the setpoint target depth of each pool in the canal by applying a volume compensating inflow of fluid to the volume of that pool;

starting with the first pool upstream in the canal, transmitting, in a downstream direction, knowledge of pool demand changes and pool volume surpluses and deficiencies to at least a second one of said pools.

7. A method for the automated control of a fluid delivery canal having a plurality of pools, the pools being successively aligned, each of the pools having sides and an invert and being defined by at least one of an upstream inflow gate and downstream outflow gate, and having a setpoint location, the setpoint location having an associated setpoint target depth, the method further for achieving and maintaining hybrid control and steady state operation of the canal despite changing demands and comprising the iterative steps of:

starting with a first pool in the canal, applying a demand compensating inflow of fluid to each pool in the canal to supply sufficient fluid to meet the changing demands;

starting with a first pool in the canal, maintaining the setpoint target depth of each pool in the canal by applying a volume compensating inflow of fluid to the volume of that pool; and starting with the first pool upstream in the canal, transmitting, in both upstream and downstream directions, knowledge of pool demand changes and pool volume surpluses and deficiencies to at least a second one of said pools.

8. The method of claim 4 wherein the canal includes a plurality of pools, the method comprising the further step, for a first pool, of transmitting knowledge of pool demand changes and pool volume surpluses and deficiencies in at least one direction, over a transmission means, to the control system of at least a second pool.

9. The method of claim 4 wherein at least one of the pools has established therefor a table of throughflows versus volumes implemented on the control system, the step of calculating a volume compensating inflow further comprising the steps of:

determining the throughflow through the one of the pools; and looking up, in the table of throughflows versus volumes, a volume compensating inflow appropriate for the throughflow of the one of the pools.

10. The method of claim 8 wherein said step of transmitting said target pool inflow requirement further comprises the step of transmitting said target pool inflow requirement from said first pool to a second pool adjacent to said first pool.

11. The method of claim 8 where said step of transmitting said target pool inflow requirement further comprises transmitting said target pool inflow requirement over an electronic transmission means.

12. The method of claim 8 further for implementing downstream control of the canal, and comprising the further step of accumulating the target pool inflow requirement from the last pool downstream in an upstream direction.

13. The method of claim 8 further for implementing upstream control of the canal, and comprising the further step of transmitting pool demand changes and pool volume surpluses and deficiencies from the first pool upstream in a downstream direction.

14. The method of claim 8 further for implementing hybrid control of the canal comprising the further step of transmitting pool demand changes and pool volume surpluses and deficiencies from a given one of said pools in both upstream and downstream directions.

* * * * *